US011339656B1

(12) United States Patent
Sollami

(10) Patent No.: US 11,339,656 B1
(45) **Date of Patent: *May 24, 2022**

(54) REAR OF BASE BLOCK

(71) Applicant: The Sollami Company, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 47 days.

This patent is subject to a terminal disclaimer.

(21) Appl. No.: 16/413,080

(22) Filed: May 15, 2019

Related U.S. Application Data

(63) Continuation of application No. 15/708,292, filed on Sep. 19, 2017, now Pat. No. 10,683,752, and a continuation-in-part of application No. 14/690,679, filed on Apr. 20, 2015, now Pat. No. 10,370,966, and a continuation of application No. 14/628,482, filed on Feb. 23, 2015, now Pat. No. 9,879,531.

(60) Provisional application No. 61/983,291, filed on Apr. 23, 2014, provisional application No. 61/944,676, filed on Feb. 26, 2014.

(51) Int. Cl.

| | |
|---|---|
| ***E21C 35/19*** | (2006.01) |
| *E21C 35/18* | (2006.01) |
| *E21C 35/197* | (2006.01) |

(52) U.S. Cl.
CPC ..... *E21C 35/191* (2020.05); *E21C 35/18* (2013.01); *E21C 35/188* (2020.05); *E21C 35/197* (2013.01)

(58) Field of Classification Search
CPC ..... E21C 35/19; E21C 35/188; E21C 35/191; E21C 35/18; E21C 35/197
See application file for complete search history.

(56) References Cited

U.S. PATENT DOCUMENTS

| | | | |
|---|---|---|---|
| 2,382,947 | A | 7/1944 | Brozek |
| 2,810,567 | A | 10/1957 | Kirkham |
| 3,342,531 | A | 9/1967 | Krekeler |
| 3,342,532 | A | 9/1967 | Krekeler |
| 3,397,012 | A | 8/1968 | Krekeler |
| 3,476,438 | A | 11/1969 | Bower, Jr. |
| 3,519,309 | A | 7/1970 | Engle |

(Continued)

FOREIGN PATENT DOCUMENTS

| | | |
|---|---|---|
| DE | 102004049710 | 4/2006 |
| DE | 102011079115 | 1/2013 |

(Continued)

*Primary Examiner* — Janine M Kreck
*Assistant Examiner* — Michael A Goodwin
(74) *Attorney, Agent, or Firm* — Mercedes V. O'Connor; Rockman Videbeck & O'Connor

(57) ABSTRACT

An improved base block is disclosed for use mainly in road milling equipment, but also capable of use in trenching equipment and mining equipment. The base mounting portion is shortened in length from such prior art base blocks and has a reduced length device receiving portion extending therefrom that includes a bore therethrough. Rearwardly of the device receiving portion, the base mounting portion includes a reduced diameter semi-bore or curved wall capable of engaging a portion of the shank side wall of a standard length bit/holder shank. Additionally, an angled slot adjacent the rear of the device receiving bore increases access to the rear to aid removal of a bit/holder therefrom.

28 Claims, 8 Drawing Sheets

(56) References Cited

U.S. PATENT DOCUMENTS

| | | | |
|---|---|---|---|
| 3,833,264 | A | 9/1974 | Elders |
| 3,833,265 | A | 9/1974 | Elders |
| 3,865,437 | A | 2/1975 | Crosby |
| 4,084,856 | A | 4/1978 | Emmerich |
| 4,247,150 | A | 1/1981 | Wrulich et al. |
| RE30,807 | E | 12/1981 | Elders |
| 4,310,939 | A | 1/1982 | Iijima |
| 4,453,775 | A | 6/1984 | Clemmow |
| 4,478,298 | A | 10/1984 | Hake |
| 4,489,986 | A | 12/1984 | Dziak |
| 4,525,178 | A | 6/1985 | Hall |
| 4,561,698 | A | 12/1985 | Beebe |
| 4,570,726 | A | 2/1986 | Hall |
| 4,604,106 | A | 8/1986 | Hall |
| 4,632,463 | A | 12/1986 | Sterwerf, Jr. |
| 4,694,918 | A | 9/1987 | Hall |
| 4,702,525 | A | 10/1987 | Sollami |
| 4,763,956 | A | 8/1988 | Emmerich |
| 4,811,801 | A | 3/1989 | Salesky |
| 4,818,027 | A | 4/1989 | Simon |
| 4,821,819 | A | 4/1989 | Whysong |
| 4,844,550 | A | 7/1989 | Beebe |
| 4,915,455 | A | 4/1990 | O'Niell |
| 4,944,559 | A | 7/1990 | Sionett |
| 5,067,775 | A | 11/1991 | D'Angelo |
| 5,088,797 | A | 2/1992 | O'Neill |
| 5,098,167 | A | 3/1992 | Latham |
| 5,159,233 | A | 10/1992 | Sponseller |
| 5,161,627 | A | 11/1992 | Burkett |
| 5,273,343 | A | 12/1993 | Ojanen |
| 5,287,937 | A | 2/1994 | Sollami |
| 5,302,005 | A | 4/1994 | O'Neill |
| 5,303,984 | A | 4/1994 | Ojanen |
| 5,352,079 | A | 10/1994 | Croskey |
| 5,370,448 | A | 12/1994 | Sterwerf, Jr. |
| 5,374,111 | A | 12/1994 | Den Besten |
| 5,415,462 | A | 5/1995 | Massa |
| 5,417,475 | A | 5/1995 | Graham et al. |
| 5,458,210 | A | 10/1995 | Sollami |
| 5,484,191 | A | 1/1996 | Sollami |
| 5,492,188 | A | 2/1996 | Smith et al. |
| 5,551,760 | A | 9/1996 | Sollami |
| 5,607,206 | A | 3/1997 | Siddle |
| 5,628,549 | A | 5/1997 | Ritchey |
| 5,720,528 | A | 2/1998 | Ritchey |
| 5,725,283 | A | 3/1998 | O'Neill |
| 5,823,632 | A | 10/1998 | Burkett |
| 5,924,501 | A | 7/1999 | Tibbitts |
| 5,931,542 | A | 8/1999 | Britzke |
| 5,934,854 | A | 8/1999 | Krautkremer et al. |
| 5,992,405 | A | 11/1999 | Sollami |
| D420,013 | S | 2/2000 | Warren |
| 6,019,434 | A | 2/2000 | Emmerich |
| 6,102,486 | A | 8/2000 | Briese |
| 6,176,552 | B1 | 1/2001 | Topka, Jr. |
| 6,196,340 | B1 | 3/2001 | Jensen et al. |
| 6,199,451 | B1 | 3/2001 | Sollami |
| 6,250,535 | B1 | 6/2001 | Sollami |
| 6,331,035 | B1 | 12/2001 | Montgomery, Jr. |
| 6,341,823 | B1 | 1/2002 | Sollami |
| 6,357,832 | B1 | 3/2002 | Sollami |
| 6,371,567 | B1 | 4/2002 | Sollami |
| 6,382,733 | B1 | 5/2002 | Parrott |
| 6,428,110 | B1 | 8/2002 | Ritchey et al. |
| 6,508,516 | B1 | 1/2003 | Kammerer |
| D471,211 | S | 3/2003 | Sollami |
| 6,585,326 | B2 | 7/2003 | Sollami |
| 6,685,273 | B1 | 2/2004 | Sollami |
| 6,692,083 | B2 | 2/2004 | Latham |
| D488,170 | S | 4/2004 | Sollami |
| 6,733,087 | B2 | 5/2004 | Hall |
| 6,739,327 | B2 | 5/2004 | Sollami |
| 6,786,557 | B2 | 9/2004 | Montgomery |
| 6,824,225 | B2 | 11/2004 | Stiffler |
| 6,846,045 | B2 | 1/2005 | Sollami |
| 6,854,810 | B2 | 2/2005 | Montgomery |
| 6,866,343 | B2 | 3/2005 | Holl et al. |
| 6,968,912 | B2 | 11/2005 | Sollami |
| 6,994,404 | B1 | 2/2006 | Sollami |
| 7,097,258 | B2 | 8/2006 | Sollami |
| 7,118,181 | B2 | 10/2006 | Frear |
| 7,150,505 | B2 | 12/2006 | Sollami |
| 7,195,321 | B1 | 3/2007 | Sollami |
| 7,210,744 | B2 | 5/2007 | Montgomery |
| 7,229,136 | B2 | 6/2007 | Sollami |
| 7,234,782 | B2 | 6/2007 | Stehney |
| D554,162 | S | 10/2007 | Hall |
| 7,320,505 | B1 | 1/2008 | Hall |
| 7,338,135 | B1 | 3/2008 | Hall |
| 7,347,292 | B1 | 3/2008 | Hall |
| D566,137 | S | 4/2008 | Hall |
| 7,353,893 | B1 | 4/2008 | Hall |
| 7,384,105 | B2 | 6/2008 | Hall |
| 7,396,086 | B1 | 6/2008 | Hall |
| 7,401,862 | B2 | 7/2008 | Holl et al. |
| 7,401,863 | B1 | 7/2008 | Hall |
| 7,410,221 | B2 | 8/2008 | Hall |
| 7,413,256 | B2 | 8/2008 | Hall |
| 7,413,258 | B2 | 8/2008 | Hall |
| 7,419,224 | B2 | 9/2008 | Hall |
| 7,445,294 | B2 | 11/2008 | Hall |
| D581,952 | S | 12/2008 | Hall |
| 7,464,993 | B2 | 12/2008 | Hall |
| 7,469,756 | B2 | 12/2008 | Hall |
| 7,469,971 | B2 | 12/2008 | Hall |
| 7,469,972 | B2 | 12/2008 | Hall |
| 7,475,948 | B2 | 1/2009 | Hall |
| 7,523,794 | B2 | 4/2009 | Hall |
| 7,568,770 | B2 | 8/2009 | Hall |
| 7,569,249 | B2 | 8/2009 | Hall |
| 7,571,782 | B2 | 8/2009 | Hall |
| 7,575,425 | B2 | 8/2009 | Hall |
| 7,588,102 | B2 | 9/2009 | Hall |
| 7,594,703 | B2 | 9/2009 | Hall |
| 7,600,544 | B1 | 10/2009 | Sollami |
| 7,600,823 | B2 | 10/2009 | Hall |
| 7,628,233 | B1 | 12/2009 | Hall |
| 7,635,168 | B2 | 12/2009 | Hall |
| 7,637,574 | B2 | 12/2009 | Hall |
| 7,648,210 | B2 | 1/2010 | Hall |
| 7,665,552 | B2 | 2/2010 | Hall |
| 7,669,938 | B2 | 3/2010 | Hall |
| 7,681,338 | B2 | 3/2010 | Hall |
| 7,712,693 | B2 | 5/2010 | Hall |
| 7,717,365 | B2 | 5/2010 | Hall |
| 7,722,127 | B2 | 5/2010 | Hall |
| 7,789,468 | B2 | 9/2010 | Sollami |
| 7,832,808 | B2 | 11/2010 | Hall |
| 7,883,155 | B2 | 2/2011 | Sollami |
| 7,950,745 | B2 | 5/2011 | Sollami |
| 7,963,617 | B2 | 6/2011 | Hall |
| 7,992,944 | B2 | 8/2011 | Hall |
| 7,992,945 | B2 | 8/2011 | Hall |
| 7,997,660 | B2 | 8/2011 | Monyak et al. |
| 7,997,661 | B2 | 8/2011 | Hall |
| 8,007,049 | B2 | 8/2011 | Fader |
| 8,007,051 | B2 | 8/2011 | Hall |
| 8,029,068 | B2 | 10/2011 | Hall |
| 8,033,615 | B2 | 10/2011 | Hall |
| 8,033,616 | B2 | 10/2011 | Hall |
| 8,038,223 | B2 | 10/2011 | Hall |
| 8,061,784 | B2 | 11/2011 | Hall |
| 8,109,349 | B2 | 2/2012 | Hall |
| 8,118,371 | B2 | 2/2012 | Hall |
| 8,136,887 | B2 | 3/2012 | Hall |
| 8,201,892 | B2 | 6/2012 | Hall |
| 8,215,420 | B2 | 7/2012 | Hall |
| 8,292,372 | B2 | 10/2012 | Hall |
| 8,414,085 | B2 | 4/2013 | Hall |
| 8,449,039 | B2 | 5/2013 | Hall |
| 8,485,609 | B2 | 7/2013 | Hall |
| 8,500,209 | B2 | 8/2013 | Hall |
| 8,540,320 | B2 | 9/2013 | Sollami |
| RE44,690 | E | 1/2014 | Sollami |

(56) References Cited

U.S. PATENT DOCUMENTS

| | | | | |
|---|---|---|---|---|
| 8,622,482 | B2 | 1/2014 | Sollami | |
| 8,622,483 | B2 | 1/2014 | Sollami | |
| 8,646,848 | B2 | 2/2014 | Hall | |
| 8,728,382 | B2 | 5/2014 | Hall | |
| 8,740,314 | B2 | 6/2014 | O'Neill | |
| 9,004,610 | B2 | 4/2015 | Erdmann et al. | |
| 9,028,008 | B1 | 5/2015 | Bookhamer | |
| 9,039,099 | B2 | 5/2015 | Sollami | |
| 9,316,061 | B2 | 4/2016 | Hall | |
| 9,518,464 | B2 | 12/2016 | Sollami | |
| 9,879,531 | B2 | 1/2018 | Sollami | |
| 9,909,416 | B1 | 3/2018 | Sollami | |
| 9,976,418 | B2 | 5/2018 | Sollami | |
| 9,988,903 | B2 | 6/2018 | Sollami | |
| 10,072,501 | B2 | 9/2018 | Sollami | |
| 10,105,870 | B1 | 10/2018 | Sollami | |
| 10,107,097 | B1 | 10/2018 | Sollami | |
| 10,107,098 | B2 | 10/2018 | Sollami | |
| 10,180,065 | B1 | 1/2019 | Sollami | |
| 10,260,342 | B1 | 4/2019 | Sollami | |
| 10,323,515 | B1 | 6/2019 | Sollami | |
| 10,337,324 | B2 | 7/2019 | Sollami | |
| 10,370,966 | B1 | 8/2019 | Sollami | |
| 10,385,689 | B1 | 8/2019 | Sollami | |
| 10,415,386 | B1 | 9/2019 | Sollami | |
| 10,502,056 | B2 | 12/2019 | Sollami | |
| 2002/0063467 | A1 | 5/2002 | Taitt | |
| 2002/0074850 | A1 | 6/2002 | Montgomery, Jr. | |
| 2002/0074851 | A1 | 6/2002 | Montgomery, Jr. | |
| 2002/0109395 | A1 | 8/2002 | Sollami | |
| 2002/0167216 | A1 | 11/2002 | Sollami | |
| 2002/0192025 | A1 | 12/2002 | Johnson | |
| 2003/0015907 | A1 | 1/2003 | Sollami | |
| 2003/0047985 | A1 | 3/2003 | Stiffler | |
| 2003/0052530 | A1 | 3/2003 | Sollami | |
| 2003/0122414 | A1 | 7/2003 | Sollami | |
| 2003/0209366 | A1 | 11/2003 | McAlvain | |
| 2004/0004389 | A1 | 1/2004 | Latham | |
| 2004/0174065 | A1 | 9/2004 | Sollami | |
| 2005/0212345 | A1 | 9/2005 | Sleep et al. | |
| 2006/0071538 | A1 | 4/2006 | Sollami | |
| 2006/0186724 | A1 | 8/2006 | Stehney | |
| 2006/0261663 | A1 | 11/2006 | Sollami | |
| 2007/0013224 | A1 | 1/2007 | Stehney | |
| 2007/0040442 | A1 | 2/2007 | Weaver | |
| 2007/0052279 | A1 | 3/2007 | Sollami | |
| 2008/0035386 | A1 | 2/2008 | Hall et al. | |
| 2008/0036276 | A1 | 2/2008 | Hall et al. | |
| 2008/0036283 | A1 | 2/2008 | Hall et al. | |
| 2008/0100124 | A1 | 5/2008 | Hall et al. | |
| 2008/0145686 | A1 | 6/2008 | Mirchandani | |
| 2008/0164747 | A1 | 7/2008 | Weaver et al. | |
| 2008/0223744 | A1* | 9/2008 | Tewes | E21C 35/18 206/349 |
| 2008/0284234 | A1 | 11/2008 | Hall et al. | |
| 2009/0146491 | A1 | 6/2009 | Fader et al. | |
| 2009/0160238 | A1 | 6/2009 | Hall et al. | |
| 2009/0256413 | A1 | 10/2009 | Majagi | |
| 2009/0261646 | A1 | 10/2009 | Ritchie et al. | |
| 2010/0045094 | A1 | 2/2010 | Sollami | |
| 2010/0244545 | A1 | 9/2010 | Hall | |
| 2010/0253130 | A1 | 10/2010 | Sollami | |
| 2010/0320003 | A1 | 12/2010 | Sollami | |
| 2010/0320829 | A1 | 12/2010 | Sollami | |
| 2011/0006588 | A1 | 1/2011 | Monyak et al. | |
| 2011/0089747 | A1 | 4/2011 | Helsel | |
| 2011/0175430 | A1 | 7/2011 | Heiderich et al. | |
| 2011/0204703 | A1 | 8/2011 | Sollami | |
| 2011/0254350 | A1 | 10/2011 | Hall | |
| 2012/0001475 | A1 | 1/2012 | Dubay et al. | |
| 2012/0027514 | A1 | 2/2012 | Hall | |
| 2012/0056465 | A1 | 3/2012 | Gerer et al. | |
| 2012/0068527 | A1* | 3/2012 | Erdmann | B28D 1/188 299/106 |
| 2012/0104830 | A1 | 5/2012 | Monyak et al. | |
| 2012/0181845 | A1 | 7/2012 | Sollami | |
| 2012/0242136 | A1 | 9/2012 | Ojanen | |
| 2012/0248663 | A1 | 10/2012 | Hall | |
| 2012/0261977 | A1 | 10/2012 | Hall | |
| 2012/0280559 | A1* | 11/2012 | Watson | E21C 35/18 299/106 |
| 2012/0286559 | A1 | 11/2012 | Sollami | |
| 2012/0319454 | A1 | 12/2012 | Swope | |
| 2013/0169023 | A1* | 7/2013 | Monyak | E21C 35/197 299/104 |
| 2013/0181501 | A1 | 7/2013 | Hall et al. | |
| 2013/0199693 | A1 | 8/2013 | Tank et al. | |
| 2013/0307316 | A1 | 11/2013 | Roetsch et al. | |
| 2014/0035346 | A1 | 2/2014 | Fundakowski et al. | |
| 2014/0110991 | A1 | 4/2014 | Sollami | |
| 2014/0232172 | A1 | 8/2014 | Roth et al. | |
| 2014/0262541 | A1 | 9/2014 | Parsana et al. | |
| 2014/0326516 | A1 | 11/2014 | Haugvaldstad | |
| 2015/0028656 | A1 | 1/2015 | Sollami | |
| 2015/0035343 | A1 | 2/2015 | Ojanen | |
| 2015/0137579 | A1 | 5/2015 | Lachmann et al. | |
| 2015/0198040 | A1 | 7/2015 | Voitic et al. | |
| 2015/0240634 | A1 | 8/2015 | Sollami | |
| 2015/0285074 | A1 | 10/2015 | Sollami | |
| 2015/0292325 | A1 | 10/2015 | Sollami | |
| 2015/0300166 | A1 | 10/2015 | Ries et al. | |
| 2015/0308488 | A1 | 10/2015 | Kahl | |
| 2015/0315910 | A1 | 11/2015 | Sollami | |
| 2015/0354285 | A1 | 12/2015 | Hall | |
| 2016/0102550 | A1 | 4/2016 | Paros et al. | |
| 2016/0194956 | A1 | 7/2016 | Sollami | |
| 2016/0229084 | A1 | 8/2016 | Lehnert | |
| 2016/0237818 | A1 | 8/2016 | Weber et al. | |
| 2017/0089198 | A1 | 3/2017 | Sollami | |
| 2017/0101867 | A1 | 4/2017 | Hall et al. | |

FOREIGN PATENT DOCUMENTS

| | | |
|---|---|---|
| DE | 202012100353 | 6/2013 |
| DE | 102015121953 | 7/2016 |
| DE | 102016118658 | 3/2017 |
| EP | 3214261 | 9/2017 |
| GB | 1114156 | 5/1968 |
| GB | 1218308 | 1/1971 |
| GB | 2483157 | 2/2012 |
| GB | 2534370 | 7/2016 |
| WO | 2008105915 A2 | 9/2008 |
| WO | 2008105915 A3 | 9/2008 |
| WO | 2009006612 | 1/2009 |

* cited by examiner

REAR OF BASE BLOCK

CROSS-REFERENCE TO RELATED APPLICATION(S)

This application claims priority to and is a continuation-in-part of U.S. Provisional Application No. 61/983,291, filed Apr. 23, 2014, claims priority to and is a continuation-in-part of U.S. Non-provisional application Ser. No. 14/690,679, filed Apr. 20, 2015, claims priority to and is a continuation of U.S. Provisional Application No. 61/944,676, filed Feb. 26, 2014, claims priority to and is a continuation of U.S. Non-provisional application Ser. No. 14/628,482, filed Feb. 23, 2015, now U.S. Pat. No. 9,879,531, issued Jan. 30, 2018, and claims priority to and is a continuation of U.S. Non-provisional application Ser. No. 15/708,292, filed Sep. 19, 2017, to the extent allowed by law and the contents of which are incorporated herein by reference in their entireties.

TECHNICAL FIELD

This disclosure relates to base blocks mainly for use in road milling machinery, but also capable of being used in mining and trenching equipment.

BACKGROUND

Road milling bits and bit holders, the design of which, when made in differing sizes, can also be used for trenching machines and mining machines, have benefitted greatly from what has been termed a "quick change tooling system," found in the instant inventor's prior U.S. Pat. Nos. 6,371,567; 6,685,273; and 7,883,155.

In Applicant's recently filed, copending provisional patent application, Ser. No. 61/944,676, filed Feb. 26, 2014, now application Ser. No. 14/628482 filed Feb. 23, 2015, and now issued as U.S. Pat. No. 9,879,531 and/or U.S. Patent Application Publication No. 2015/0240634, Applicant discloses the findings that most of the retaining force between the diametrically compressed slotted portion of the shank in a quick change system and the base block bore is radially located near the top of the slotted portion of the shank. Indeed, the further one gets from the top of the slot, the less the distal end of the approximately 2½ inch long shank applies force to the base block bore.

In Applicant's copending application, identified above, Applicant has shortened the shank from a full length of approximately 2⅜ inches to about 1½ inches in length and has obtained about the same retention force between the bit/holder shank and the base block bore, between about 5,000 and 30,000 pounds of radial force.

A need has developed for providing additional access to the rear of a base block for removing a bit, a bit holder or a combination bit/holder.

SUMMARY

This disclosure relates generally to bit and/or pick assemblies for road milling, mining, and trenching equipment. One implementation of the teachings herein is a base block that includes a bit holder block that includes a base and a bit holder receiving portion extending from a side of the base opposite a bottom of the base, and including a predetermined angle of attach with respect to the base, the bit holder receiving portion including a bit holder block bore therethrough, the bit holder block bore having a nominal length and diameter of about equal dimensions, and the side of the base opposite the bottom extends at least an inch past a rear of the bit holder receiving portion.

Another implementation of the teachings herein is a bit holder block that includes a base and a bit holder receiving portion extending from a side of the base opposite a bottom of the base, and including a predetermined angle of attach with respect to the base, the bit holder receiving portion including a bit holder block bore therethrough, the bit holder block bore having a nominal length and diameter of about equal dimensions, and the side of the base opposite the bottom extends at least an inch past a rear of the bit holder receiving portion These and other aspects of the present disclosure are disclosed in the following detailed description of the embodiments, the appended claims and the accompanying figures.

BRIEF DESCRIPTION OF THE DRAWINGS

The features of the present disclosure which are believed to be novel are set forth with particularity in the appended claims. The disclosure may best be understood from the following detailed description of currently illustrated embodiments thereof taken in conjunction with the accompanying drawings wherein like numerals refer to like parts, and in which:

DETAILED DESCRIPTION

Figure 2:
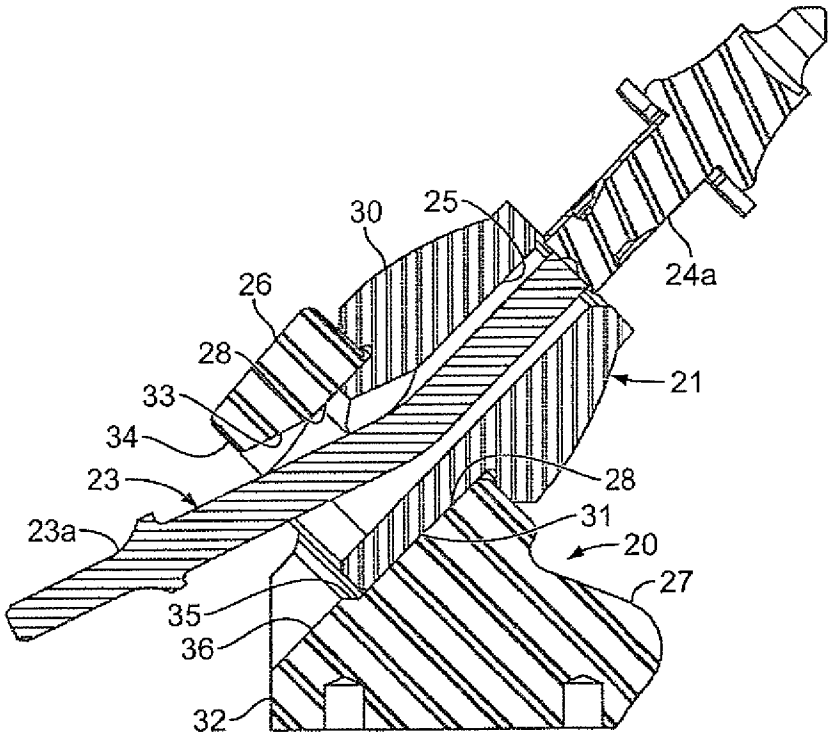
FIG. 2 is a cross sectional view taken along Line 2-2 of FIG. 1.
Figure 1:
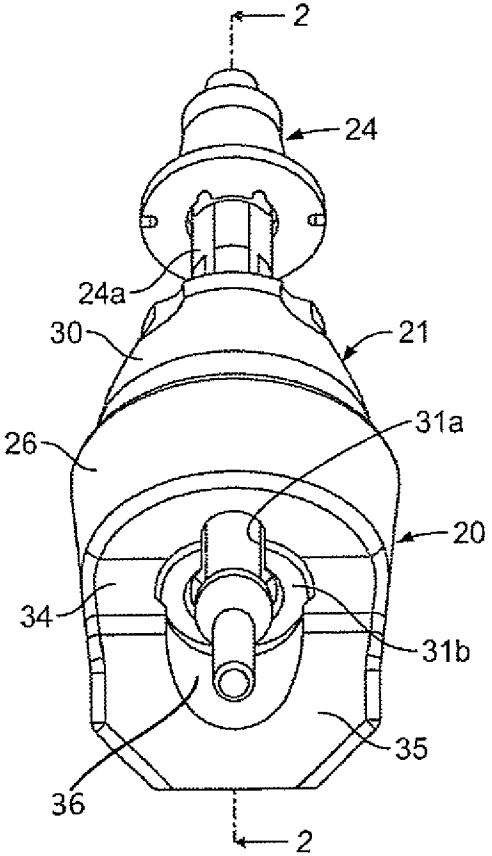
FIG. 1 is an end elevational view of a bit assembly, constructed in accordance with the present disclosure, with the addition of a bit removal tool shown forcing a bit out of its bit holder.
Figure 3:
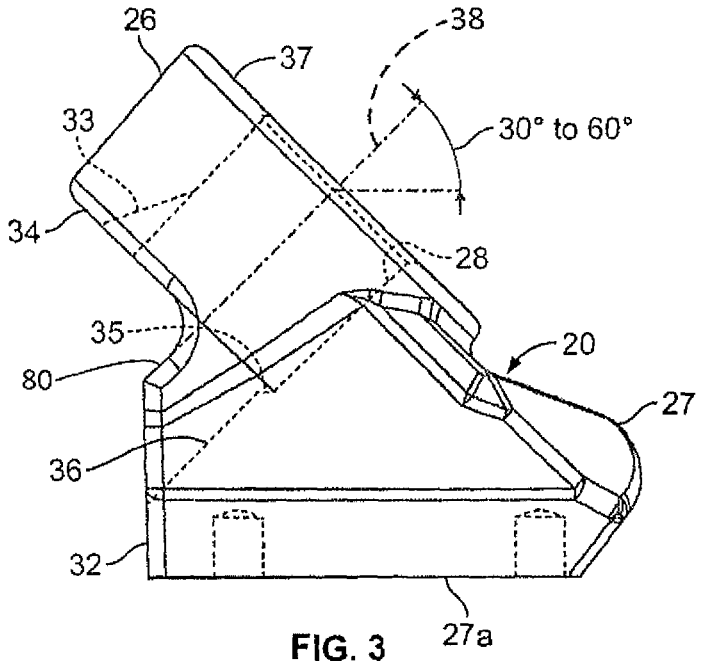
FIG. 3 is a side elevational view of the first embodiment of the bit block shown in FIG. 1.

Referring to FIGS. 1, 2, and 3, a first embodiment of a base block 20, constructed in accordance with the present disclosure, is shown together with a first embodiment of a bit holder 21 mounted therein in FIGS. 1 and 2, and also showing an angled drift pin 23 pushing out a bit 24 from the central bore 25 of the bit holder 21.

The base block 20 shown in FIGS. 1, 2, and 3 is a modification of the base block shown in Applicant's recently filed and copending provisional application Ser. No. 61/944,676 filed Feb. 26, 2014, now Ser. No. 14/628,482 filed Feb. 23, 2015, the contents and drawings of which are incorporated herein by reference.

As in the '482 application, the base block 20 of FIGS. 1, 2, and 3 includes a shortened front end 26 and a base 27 including a base surface 27*a* (FIG. 3) which may be flat or slightly concave to fit a drum or additional mounting plates thereon (not shown) on which a plurality of base blocks may be mounted, usually in chevron or spiral fashion. Outwardly of the mounting portion or base of the base block 20, is a generally annular bit holder mounting portion, also called a device receiving portion, or front end 26, having a central nominal 1½ inch diameter annular or generally cylindrical bore 28 positioned therethrough which is generally positioned at between 30 to 60 degrees from the horizontal. The annular device receiving or bit holding portion 26 of the base block is, in this embodiment, about 1½ inches in length or greater and is configured to receive a bit holder or a device.

As in the previous embodiment, the base block bore 28 has been shortened from about 2⅜ inches in length to 1½ inches in length preferably by removing material from the back of the mounting portion, and thus providing added space behind the device receiving or holder mounting portion 26 of the base block 20. This added space from prior art base blocks provides additional access up to about ⅞ inch from the mounting portion for tools to remove or punch out either bits 24 from a bit holder annular or circular bore 25, or a bit holder 21 from the base block bore 28. FIGS. 1 and 2 show a bit 24 or broken shank with its generally cylindrical shank 24*a* being pushed out of a bit holder bore 25 by a bent drift pin 23 which is configured on its base end 23*a* to fit into a pneumatically operated tool (not shown).

The bit holder 21 shown in FIG. 2 has an upper body portion 30, and a lower shank portion 31 which is slotted at 31*a* to allow the shank 31 to compress radially when inserted in the base block bore 28. The force between the diametrically contracted slotted shank 31 and the base block bore 28 maintains and retains the bit holder 21 in the bit block 20. In the instant application, the bit block annular portion 26 has been shortened from approximately 2⅜ inches in length, which is the bit holder shank length utilized in Applicant's U.S. Pat. Nos. 6,371,567; 6,685,273; and 7,883,155, the contents and drawings of which are incorporated herein by reference.

As indicated in the preceding application noted above, Applicant has discovered that the bulk of the forces between the slotted shank 31 of the bit holder 21 and the base block bore 28 occur adjacent the top of the slot 31*a* in the shank 31. Indeed, in the copending application, Applicant has disclosed a shank that is configured at a more outwardly extending angle than the angle of the base block bore. That is, if the shank 31 is a straight cylindrical member, the bit block bore 28 will be slightly tapered inwardly, or tapered to the centerline of the holder.

By adjusting the relative angles between the outer surface of the shank 31 and the base block bore 28, the position of the forces between those two structures may be engineered to occur where most beneficial along the axis of the shank 31.

Returning to the base block 20, the base block of the present disclosure has several distinct differences from the base block shown in the copending patent application. First, the bottom end 34 of the base block bore 28, in this embodiment, includes a semi cylindrical angular slot 33, preferably at the radially outermost portion of the base block bore. This angular slot 33 allows added room for the drift pin 23 shown in FIG. 2 to operate to drive out either the bit or the holder. Additionally, in the cutaway portion of the bottom or rear end 34 of the annular bit holder shank holding or receiving portion of the base block 20, adjacent the mounting portion 27 of the base block, a transitional first reduced radius angular wall or discontinuity 35 is formed on the bore relative to the bore axis or centerline 38 such that a second segmental radius leads to a slightly smaller third radius extension or cutaway portion 36. The extension of the arcuate segment 36 extends onto a surface 80 (FIGS. 3, 4, 10, and 11) of the base block 20. The surface 80 extends to a first plane including the central axis 38 of the bore and/or a second plane below the first plane. This reduced radius extension of an arcuate segment of said bore 36, which may be ⅞ inch in length does not serve a function when the base block and shorter shank bit holder are used. But its function will be disclosed in more detail below.

As mentioned in connection with FIG. 3, the bore 28 through the bit holder holding portion of the base block 20 may be cylindrical, or slightly inwardly tapered or slightly outwardly tapered as long as the shank 31 of the bit holder extends outwardly more at its distal end 31*b* than that of the bit holder block bore 28. As noted previously, if it is desirable to have more radial interference between the bit holder shank 31 and the base block bore 28 adjacent the top 37 of the base block bore 28, this shank portion may be increased in diameter relative to that of the base block holder bore.

FIG. 3 discloses a base block bore 28 that is either a continuous cylindrical or an inwardly tapered angle continuously along its length from the top 37 of the bit holder mounting portion to the bottom 34 of the bit holder shank mounting portion 26. This bore 28 is generally positioned at a 30 to 60 degree angle to the bottom surface 27*a* of the base block 20. The semicircular angled slot 33, also shown in FIG. 1, is shown in dotted line adjacent the outermost portion of the base block bore 28 for allowing increased access of a drift pin removal tool 23 to the back of the base block 20. The reduced diameter 36, as shown most clearly in FIG. 1, starting at the inner portion of the base block bore 28 subjacent the outer back wall 34 of the bit holder shank retaining portion is shown in dotted line 36 as it extends up to about ⅞ inch from that back wall 34 to the rear 32 of the base block mounting portion 27.

Figure 4:
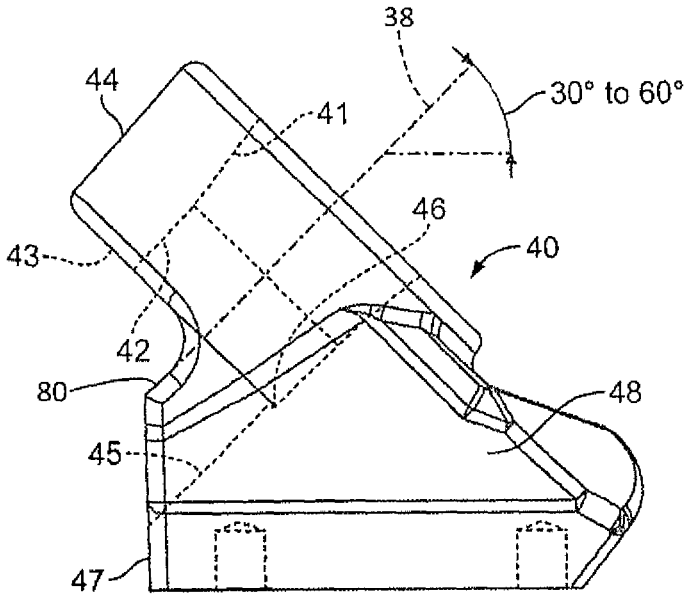
FIG. 4 is a side elevational view of a first modification of the base block shown in FIG. 1.

FIG. 4 discloses a first modification 40 of the base block shown in FIG. 3 wherein the bit block bore includes an upper section 41 that is tapered adjacent the top of the bit holder retaining portion 44, forming an acute angle to the centerline 38 of the bit block bore in this illustrated embodiment, approximately half way through the bit block bore wherein the remainder or lower section 42 of the bit block bore is generally cylindrical in shape to the back wall 43 of the bit holder retaining portion 44. Again, a slight transverse reduced diameter 45 is shown that extends from the ridge 46 at the back of the bit holder block bore 42 to the rearmost portion 47 of the mounting portion 48 of the base block 40.

Figure 5:
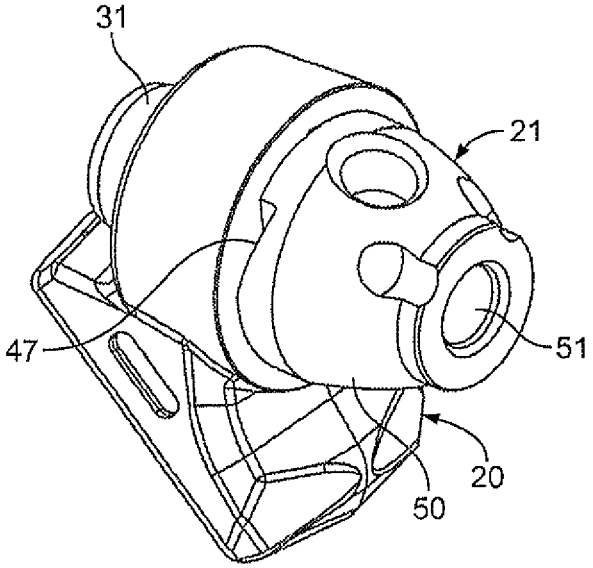
FIG. 5 is a ¾ front perspective view of the base block shown in FIG. 1 with a long shank bit holder mounted therein.
Figure 6:
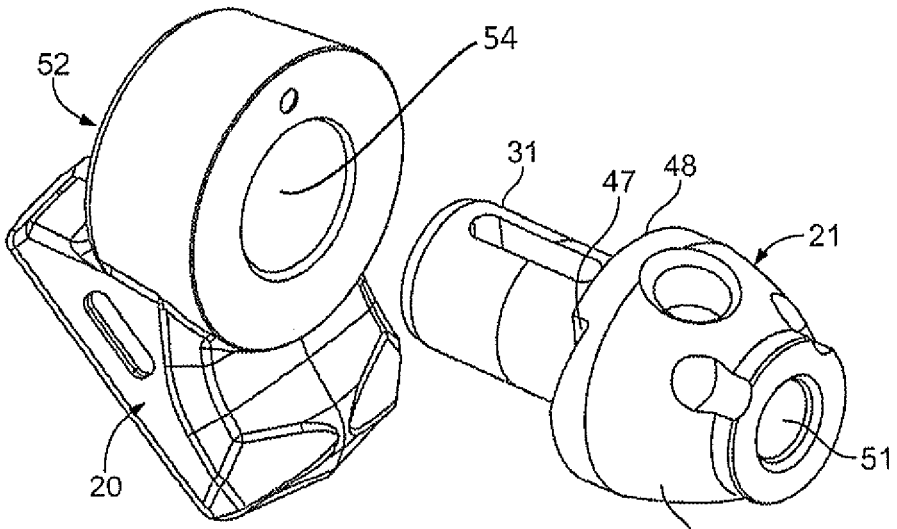
FIG. 6 is a ¾ front exploded view of the long shank bit holder shown in FIG. 5 extended outwardly of the base block shown in FIG. 5.

Referring to FIGS. 5 and 6, the base block 20 of the present disclosure is shown with a standard 2⅜ inch length bit holder 21 mounted therein instead of the 1½ inch shank length bit holder. A pair of wedge shape notches 47 (one shown) in the back annular face 48 (FIG. 8) of the body portion 50 of the bit holder body extend transversely near the axis of the shank a distance about ⅛ inch shy of the position of a plane perpendicular to the axis of the bore 51.

The configuration shown in FIGS. 5-11 of the instant application disclose the use of the shortened bit holding portion 52 which includes annular bore 54 through the present base block 20 in combination with a standard length shank bit holder 21 as shown in Applicant's prior patents.

When Applicant's disclosure is utilized for road milling, mining or trenching operations, the use to which the assembly is subjected is extreme in nature. The industry has worked diligently through the years to increase the useful life of bits, combination bit/holders, and base blocks while performing the extremely tough cutting conditions to which they are subjected. Applicant's present disclosure utilizing the shortened base block bit holder mounting portion and the shortened bit holder shank on the bit/holder provides substantial benefits over the prior art. However, eventually, these extreme forces will account for wear in the base block bore and wear on the bit holder shank such that a standard short shank bit holder may not successfully be retained in the base block bore.

When such is the case, even after the added cycle of life provided by the instant disclosure, Applicant's present disclosure provides for utilizing a standard 2⅜ inch length bit holder shank 31 in the improved base block to provide additional use of the base block than heretofore known.

Figure 8:
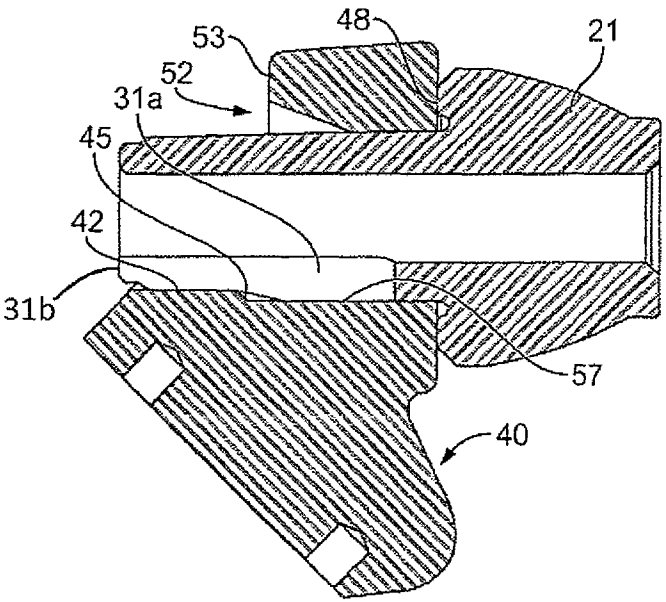
FIG. 8 is a cross sectional view of the bit holder and base block of the current disclosure with a long standard 2⅜ inch shank inserted in the bit block.
Figure 7:
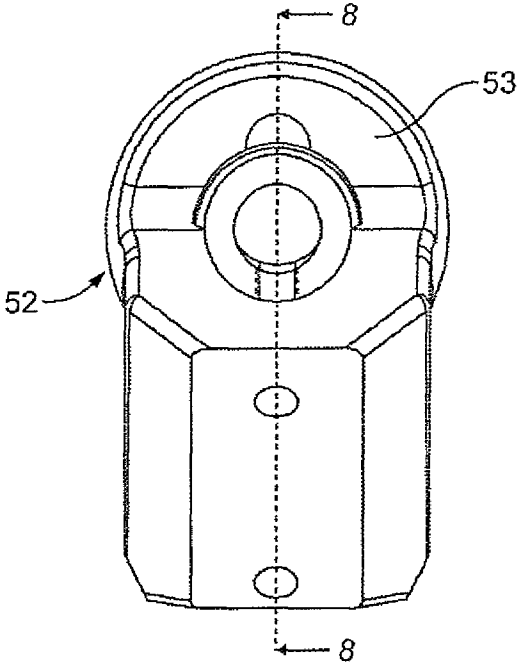
FIG. 7 is an end elevational view of the base block of the present disclosure.

FIGS. 7 and 8 show the use of the standard 2⅜ inch length shank bit holder 21 as mounted in the base block 40 of the first modification of the present disclosure. As shown most clearly in FIG. 8, the added reduced diameter interference portion 42 at the rearmost portion of the bit block bore 46 beyond the end or back wall 53 of the bit holder shank retaining portion engages the 2⅜ inch long shank 31 of the bit holder 20 adjacent its distal end and provides sufficient sideways force against that portion of the shank 31 to retain same in the base block 40. The ridge shown in FIG. 8 has been enhanced in size to show its effect in use. Such a ridge 45 and smaller segment portion 42 would be expected to be less than about 0.050 inch in interference.

In the example shown in FIG. 8, the slotted portion of the bit holder shank 31*a* is positioned adjacent the curved reduced diameter wall 42 and ridge 45 to provide the amount of elastic bend to that portion of the shank 31 to retain the shank in the base block bore 51.

Figure 10:
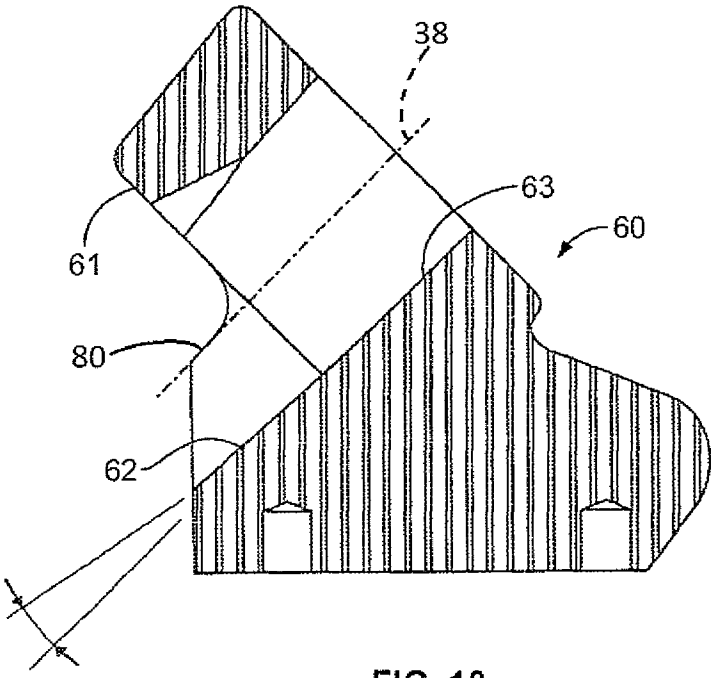
FIG. 10 is a cross sectional view taken along Line 10-10 of FIG. 9 wherein the portion of the bit block bore extending from the back of the bit holder retaining portion is slightly tapered at an angle relative to the annular bore to retain a long shank bit holder therein.
Figure 9:
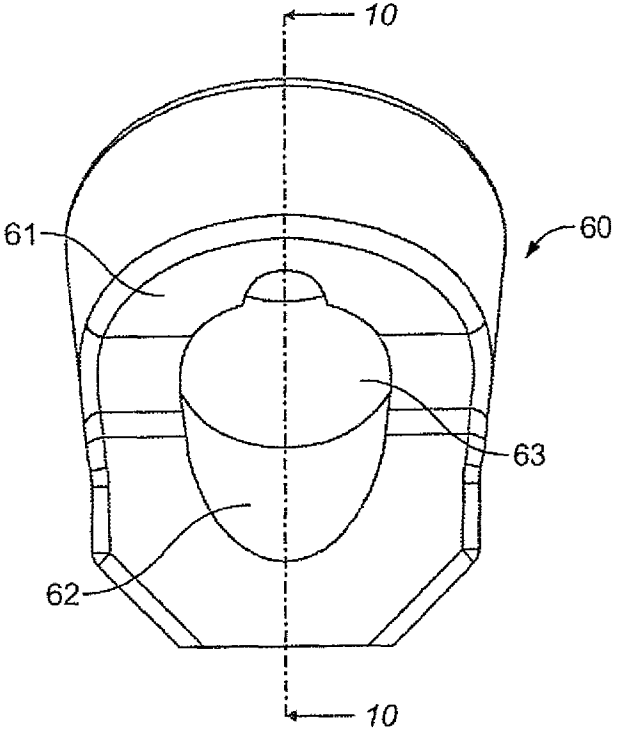
FIG. 9 is an end elevational view of a second modification of the base block shown in FIG. 7.
Figure 12:
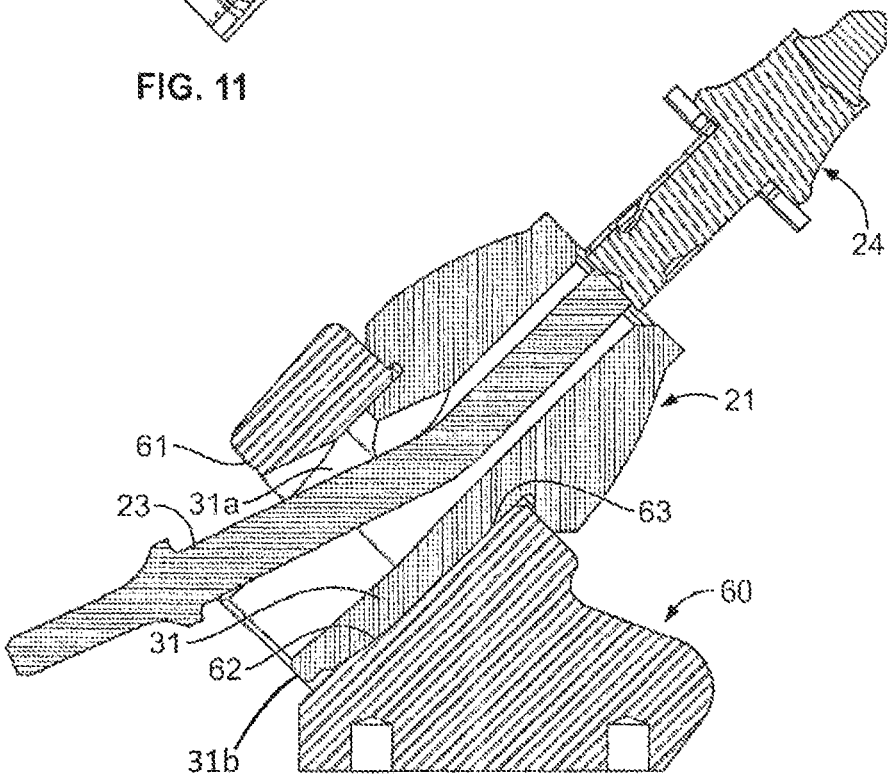
FIG. 12 is a cross sectional view similar to FIG. 10 showing a bit holder mounted in the base block and a drive punch driving out a bit therefrom.
Figure 13:
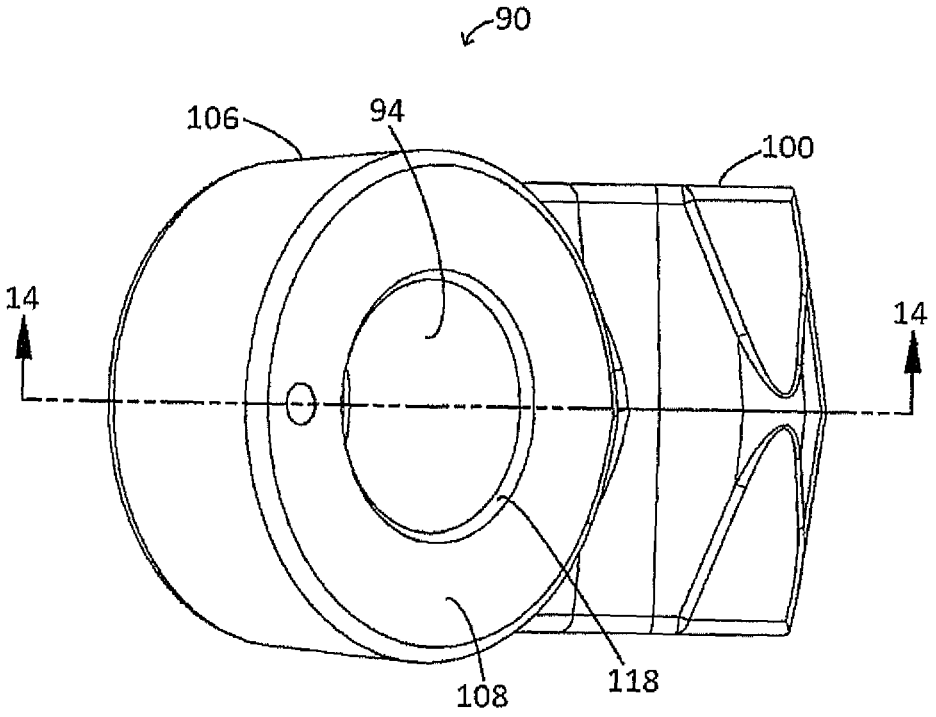
FIG. 13 is a top perspective view of a fourth modification of a base block in accordance with implementations of this disclosure.

Referring to FIGS. 9, 10, and 12, a second modification of the base block 60 is shown that, while being similar to the first embodiment and first modification thereof does not have a predominant differential diameter ridge adjacent the rear wall of the bit holder shank retaining portion 61 of the base block 60, but has a gradual inwardly tapering or smoothly transitional surface 62 instead which provides a smaller diameter than the radial distance to the axis at the rear of the bit holder block bore 63.

This smaller radius rearmost portion 62 is most useful as shown in FIG. 12, when the solid or internal slotted portion 31*a* of the standard length shank bit holder 21 is mounted in the base block 60 of the second modification of the present disclosure. The slotted portion 31*a* in a single slotted shank holder 21 can be positioned opposite the smaller semicircular reduced diameter angled segment 62 similar to that bit holder shank position shown in FIG. 8. A lesser interference fit in such case may be required. A slight increasing resistance will be obtained when inserting the standard length bit holder shank 31 in the bit block bore 63 than in the first modification shown in FIG. 8.

Figure 11:
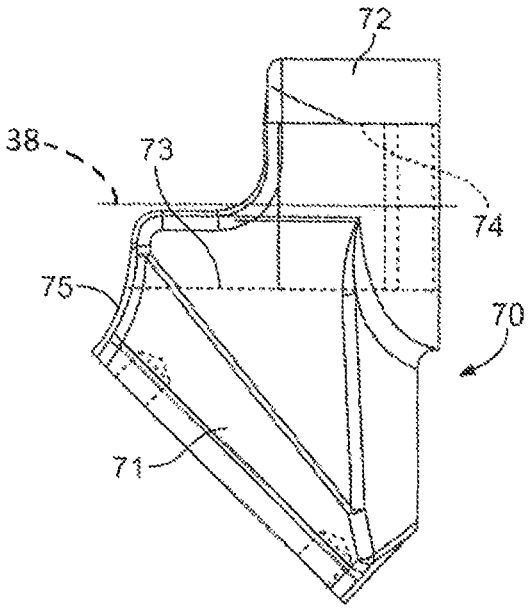
FIG. 11 is a side elevational view of a third modification of the base block shown in FIG. 10 where the annular bore and the rear arcuate extension of same are of the same angular configuration.

Referring to FIG. 11, a third modification 70, of the base block of the disclosure is similar to the first and second base block modifications 40 and 60, respectively. The base or drum mounting portion 71 of the base block mounts the block on a drum (not shown) identically to the previous embodiment and modifications. The outside of the annular bit holding portion 72 is also identical to the previously disclosed embodiment and modifications. The change to the third modification is the continuous angular orientation of the backside arcuate wall 73 extending from the rear of the annular base block bore 74 to the back end 75 of the drum mounting portion. Arcuate wall 73 is formed at the same angle as that of annular bore 74, i.e., from a non-locking taper of 1-3 degrees per side to a straight cylindrical bore.

FIG. 12 shows a construction that is similar to the first embodiment of the disclosure shown in FIG. 2 in that a bent drift pin 23 may be utilized at the rear of the second modification of the base block 60 to drive a bit 24 from the bit holder 21. It should be noted that the embodiments and modifications shown in the present disclosure can be utilized with a combined bit/holder shown in Applicant's copending patent application Ser. No. 61/879,353, filed Sep. 18, 2013 now application Ser. No. 14/487,493 filed Sep. 15, 2014, wherein the bit/holder does not have a separate bit mountable on the front end of the bit holder but utilizes a diamond tipped insert mounted in a unitary construction bit/holder. Arcuate surface 62 (FIG. 12) and arcuate surface 73 (FIG. 11) will aid the remainder of the base block bore in retaining a standard length shank as long as the interference between the two is at least 0.005 inch on the diameter and preferably more. The arcuate surface may have a radius greater, equal to or less than the bore as long as there is at least the minimum interference therebetween.

Figure 14:
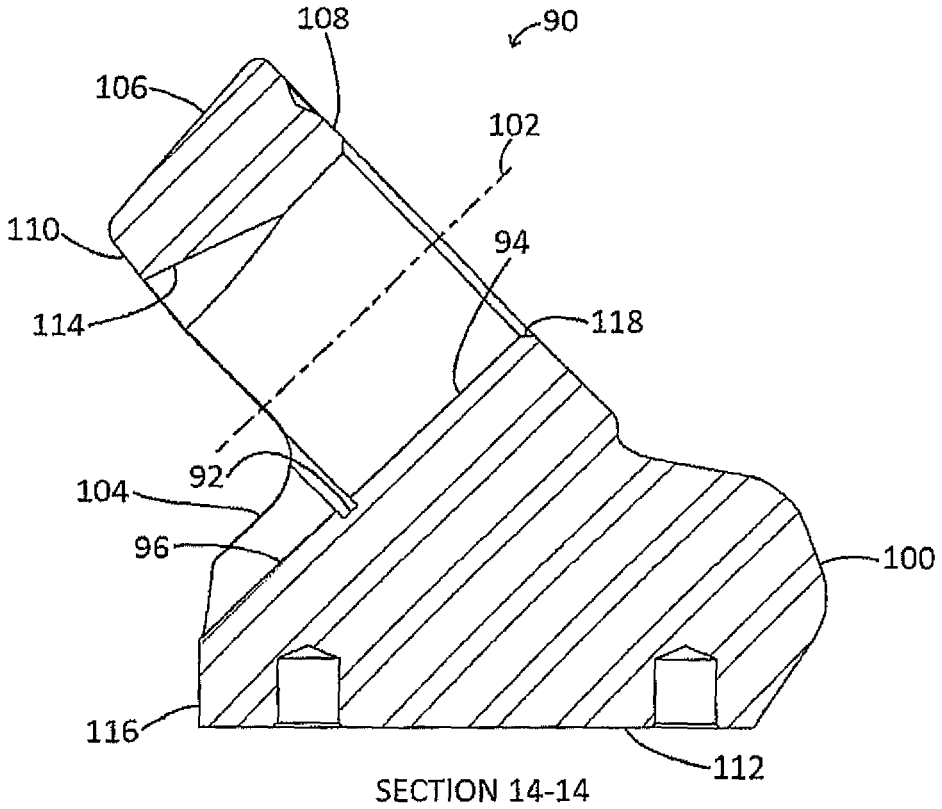
FIG. 14 is a cross sectional view of the fourth modification of the base block, taken along Line 14-14 of FIG. 13, in accordance with implementations of this disclosure.
Figure 17:
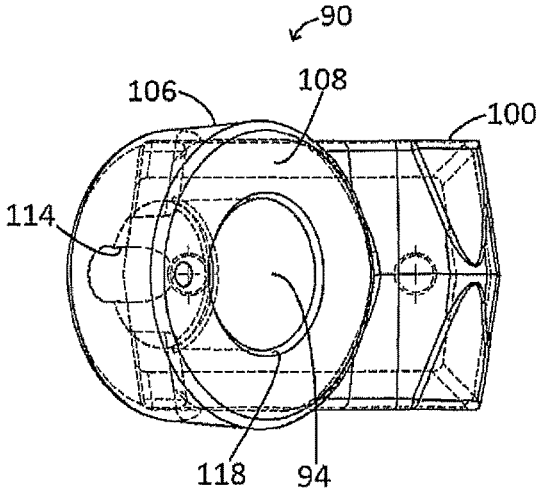
FIG. 17 is a top perspective view of the fourth modification of the base block, showing invisible internal elements in dotted lines, in accordance with implementations of this disclosure.
Figure 15:
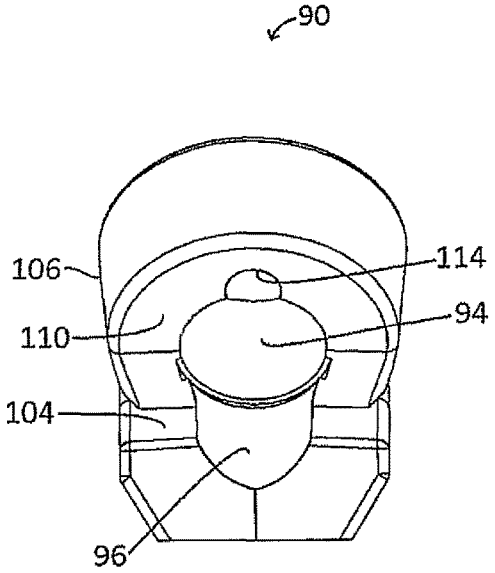
FIG. 15 is a rear perspective view of the fourth modification of the base block in accordance with implementations of this disclosure.
Figure 16:
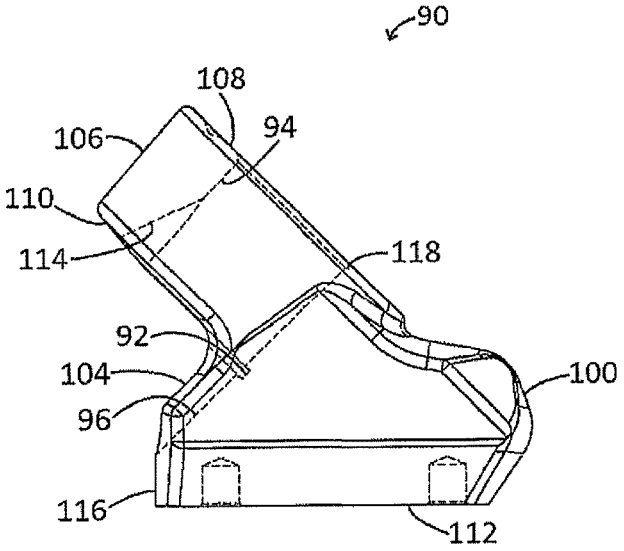
FIG. 16 is a side elevational view of the fourth modification of the base block, showing invisible internal elements in dotted lines, in accordance with implementations of this disclosure.

Referring to FIGS. 13-17, a fourth modification of the base block 90 is shown that, while being similar to the first embodiment, first modification, second modification, and third modification, includes an undercut 92 (FIGS. 14 and 16) disposed between the base block bore 94 and the extension of an arcuate segment 96. In the cutaway portion of the bottom or rear end of the annular bit holder shank holding or receiving portion 106 of the base block 90, adjacent the mounting portion 100 of the base block 90, the increased radius undercut or discontinuity 92 formed on the base block bore 94 relative to the bore axis or centerline 102 (FIG. 14). The extension of the arcuate segment 96 extends onto a surface 104 of the base block 90. The surface 104, in this exemplary implementation, extends to a first plane including the central axis 102 of the bore 94 and/or a second plane below the first plane.

The extension of the arcuate segment 96 of the bore 94, which may be 1⅛ inch in length in this embodiment, does not serve a function when a shorter shank bit holder is used with the base block 90. Once the base block bore 94 wears from use, the shorter shank bit holder can be replaced by a standard 2⅜ inch length shank 31 bit holder 21. As described above, the extension of an arcuate segment 96 at the rearmost portion of the base block bore 94 beyond the end or back wall 110 of the bit holder shank holding or receiving portion 106 engages the standard 2⅜ inch length shank 31 of the bit holder 21 adjacent its distal end and provides sufficient sideways force against that portion of the shank 31 retain the shank 31 in the base block 90. The extension of an arcuate segment 96 can have a slightly smaller radius than the base block bore 94, a greater radius than the base block bore 94, or can have the same radius as the base block bore 94, as long as there is at least the minimum interference required to aid the remainder of the base block bore 94 in retaining a standard length shank, which in this exemplary implementation, the minimum interference between the two is at least 0.005 inch on the diameter and preferably more.

The base block bore 94 may be cylindrical, slightly inwardly tapered, or slightly outwardly tapered, or any combination thereof, as long as the shank 31 of the bit holder 21 extends outwardly more at its distal end 31*b* (FIGS. 1, 8, and 12) than that of the base block bore 94. In this illustrated modification, the base block bore 94 includes an upper section or chamfer 118 (FIGS. 14 and 16) that is tapered adjacent the top of the bit holder shank holding or receiving portion 106. As previously described, if it is desirable to have more radial interference between the bit holder shank 31 and the base block bore 94 adjacent the top 108 of the base block bore 94, this shank portion may be increased in diameter relative to that of the base block holder bore.

A semicircular angled slot 114 (FIG. 14) adjacent the outermost portion of the base block bore 94 for allowing increased access of the drift pin removal tool 23 (FIGS. 2 and 12) to the back of the base block 90. The extension of an arcuate segment 96 starts subjacent the undercut 92 and extends up to about 1⅛ inch from the back wall 110 of the bit holder shank holding or receiving portion 106 to the rear 116 (FIGS. 14 and 16) of the base block mounting portion 100.

In another implementation, as also described in relation to FIG. 3, the base block bore 94 can also be either a continuous cylindrical or an inwardly tapered angle continuously along its length from the top 108 of the bit holder shank holding or receiving portion 106 to the bottom 110 of the bit holder shank holding or receiving portion 106. In this case, the bore 94 is generally positioned at a 30 to 60 degree angle to the bottom surface 112 (FIGS. 14 and 16) of the base block 90.

As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, "X includes at least one of A and B" is intended to mean any of the natural inclusive permutations. That is, if X includes A; X includes B; or X includes both A and B, then "X includes at least one of A and B" is satisfied under any of the foregoing instances. The articles "a" and "an" as used in this application and the appended claims should generally be construed to mean "one or more" unless specified otherwise or clear from context to be directed to a singular form. Moreover, use of the term "an implementation" or "one implementation" throughout is not intended to mean the same embodiment, aspect or implementation unless described as such.

While the present disclosure has been described in connection with certain embodiments and measurements, it is to be understood that the disclosure is not to be limited to the disclosed embodiments and measurements but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A base block comprising:

a base mounting portion including a base surface;

a device receiving portion integrally extending from said base mounting portion opposite said base surface;

a generally cylindrical throughbore extending through said device receiving portion, said throughbore comprising a first radius, and said throughbore oriented at an acute angle to said base surface;

an open extension comprising an arcuate segment of said throughbore, the extension extending past a rear of said device receiving portion and onto a surface of said base mounting portion, the extension comprising a second radius, and the surface of said base mounting portion axially extending from the rear of said device receiving portion; and a portion disposed between the throughbore and the extension, the portion comprising a constant third radius that is greater than the first radius of the throughbore and the second radius of the extension.

2. The base block of claim 1, the second radius of the extension is one of less than and equal to the first radius of the throughbore.

3. The base block of claim 1, said generally cylindrical throughbore in said device receiving portion is less than 2⅜ inches in length.

4. The base block of claim 1, the device receiving portion and the extension of the arcuate segment of the throughbore comprising a combined length equivalent to a full length bit holder shank of approximately 2⅜ inches.

5. The base block of claim 1, wherein the extension is semicircular.

6. The base block of claim 1, said generally cylindrical throughbore comprising an axial length of about 1½ inches and a nominal diameter of 1½ inches.

7. The base block of claim 1, wherein a total throughbore length plus extension length is greater than 1½ inches.

8. The base block of claim 1, said generally cylindrical throughbore of said device receiving portion of said base block comprising the same orientation to a centerline of said throughbore from a first position adjacent a top surface of said device receiving portion to a second position adjacent a bottom thereof.

9. A base block comprising:

a base mounting portion including a base surface;

a device receiving portion integrally extending from said base mounting portion opposite said base surface;

a generally cylindrical throughbore extending through said device receiving portion, said throughbore comprising a first radius, and said throughbore oriented at an acute angle to said base surface;

an extension of said throughbore comprising an otherwise open but arcuate segment of said throughbore, said extension comprising a second radius, and said extension extending past a rear of said device receiving portion and onto said base mounting portion;

a portion disposed between the throughbore and the extension, the portion comprising a constant third radius that is greater than the first radius of the throughbore and the second radius of the extension; and the generally cylindrical throughbore of the device receiving portion includes a semicircular angular slot extending inwardly from a rear of the device receiving portion, the angular slot enclosed within a side wall of the device receiving portion and decreasing in size from the rear of the device receiving portion to a position mediate a front portion of the device receiving portion and the rear of the device receiving portion.

10. The base block of claim 9, the second radius of the extension is one of less than and equal to the first radius of the throughbore.

11. The base block of claim 9, said generally cylindrical throughbore in said device receiving portion is less than 2⅜ inches in length.

12. The base block of claim 9, the device receiving portion and the extension of the arcuate segment of the throughbore comprising a combined length equivalent to a full length bit holder shank of approximately 2⅜ inches.

13. The base block of claim 9, wherein the extension is semicircular.

14. The base block of claim 9, said generally cylindrical throughbore comprising an axial length of about 1½ inches and a nominal diameter of 1½ inches.

15. The base block of claim 9, wherein a total throughbore length plus extension length is greater than 1½ inches.

16. The base block of claim 9, said generally cylindrical throughbore of said device receiving portion of said base block comprising the same orientation to a centerline of said throughbore from a first position adjacent a top surface of said device receiving portion to a second position adjacent a bottom thereof.

17. A base block capable of retaining a generally cylindrical shank of a device therein, said base block comprising:

a base mounting portion including a base surface;

a device receiving portion integrally extending from said base mounting portion opposite said base surface;

a generally cylindrical throughbore extending through said device receiving portion, said throughbore comprising a first radius, and said throughbore oriented at an acute angle to said base surface;

a surface of said base mounting portion comprising an extension of an arcuate segment of said throughbore, said extension comprising a second radius, said extension extending past a rear of said device receiving portion, the surface of said base mounting portion axially extending from the rear of said device receiving portion, and said extension of the arcuate segment of said throughbore providing an interference fit with the shank of said device capable of being securely mounted through said generally cylindrical throughbore and having said shank extending outwardly of a rear of said device receiving portion; and a portion disposed between the throughbore and the extension, the portion comprising a constant third radius that is greater than the first radius of the throughbore and the second radius of the extension.

18. The base block of claim 17, said interference fit is at least partly provided by a continuous angular orientation of said extension.

19. The base block of claim 17, said extension of the arcuate segment of said throughbore provides an interference fit of at least 0.005 inch diametrically with the shank of said device mounted in said throughbore.

20. The base block of claim 17, said generally cylindrical throughbore comprising an axial length of about 1½ inches and a nominal diameter of 1½ inches.

21. The base block of claim 17, wherein a total throughbore length plus extension length is greater than 1½ inches.

22. The base block of claim 17, said generally cylindrical throughbore of said device receiving portion of said base block comprising the same orientation to a centerline of said throughbore from a first position adjacent a top surface of said device receiving portion to a second position adjacent a bottom thereof.

23. A base block comprising:

a base mounting portion including a base surface;

a device receiving portion integrally extending from said base mounting portion opposite said base surface of said base mounting portion;

a generally cylindrical throughbore extending through said device receiving portion, said throughbore comprising a first radius, and said throughbore oriented at an acute angle to said base surface;

an extension of an arcuate segment of said throughbore, said extension comprising a second radius, and said extension being at least one of contiguous and continuous with said throughbore extending past a rear of said device receiving portion and onto said base mounting portion, and said extension oriented at the acute angle to the base surface; and a portion disposed between the throughbore and the extension, the portion comprising a constant third radius that is greater than the first radius of the throughbore and the second radius of the extension.

24. A base block capable of retaining a generally cylindrical shank of a device therein, said base block comprising:

a base mounting portion including a base surface;

a device receiving portion integrally extending from said base mounting portion opposite said base surface;

a generally cylindrical throughbore extending through said device receiving portion, said throughbore oriented at an acute angle to said base surface;

a surface of said base mounting portion comprising an extension of an arcuate segment of said throughbore, the extension extending past a rear of said device receiving portion and onto the surface of said base mounting portion, the surface of said base mounting portion axially extending from the rear of said device receiving portion, the surface extending to at least one of a first plane including a central axis of said throughbore and a second plane below the first plane and said extension of the arcuate segment of said throughbore providing an interference fit with the shank of said device capable of being securely mounted through said generally cylindrical throughbore and including said shank extending outwardly of a rear of said device receiving portion; and an angular wall extending from the throughbore to the extension, the angular wall oriented at the acute angle to the base surface.

25. A base block comprising:

a base mounting portion including a base surface;

a device receiving portion integrally extending from said base mounting portion opposite said base surface;

a generally cylindrical throughbore extending through said device receiving portion, said throughbore oriented at an acute angle to said base surface;

an extension of an arcuate segment of said throughbore, said extension extending past a rear of said device receiving portion and onto a surface of said base mounting portion, the surface of said base mounting portion axially extending from the rear of said device receiving portion, the surface extending to at least one of a first plane including a central axis of said throughbore and a second plane below the first plane, and said extension of the arcuate segment of said throughbore providing an interference fit with the shank of said device capable of being securely mounted through said generally cylindrical throughbore and including said shank extending outwardly of a rear of said device receiving portion;

an angular wall extending from the throughbore to the extension, the angular wall oriented at the acute angle to the base surface; and the generally cylindrical throughbore of the device receiving portion includes an angular slot extending inwardly from the rear of the device receiving portion, the angular slot enclosed within a side wall of the device receiving portion and decreasing in size from the rear of the device receiving portion to a position mediate a front portion of the device receiving portion and the rear of the device receiving portion.

26. A bit holder block capable of retaining a generally cylindrical shank of a device therein, the bit holder block comprising:

a base and a bit holder receiving portion extending from a side of the base opposite a bottom of the base, the bottom of the base defining a base surface, and including a predetermined angle of attach with respect to the base, the bit holder receiving portion including a bit holder block bore therethrough;

the bit holder block bore comprising a nominal length and diameter of about equal dimensions, said bit holder block bore oriented at an acute angle to said base surface;

the side of the base opposite the bottom axially extending at least an inch past a rear of the bit holder receiving portion, the side of the base extending to at least one of a first plane including a central axis of said bit holder block bore and a second plane below the first plane; and the side of the base comprising an extension of an arcuate segment of the bit holder block bore extending past the rear outwardly of the bit holder receiving portion, said extension oriented at the acute angle to the base surface, and said extension of the arcuate segment of the bit holder block bore providing an interference fit with the shank of said device capable of being securely mounted through said bit holder block bore and including said shank extending outwardly of the rear of the bit holder receiving portion.

27. The bit holder block of claim 26, wherein:

the bit holder receiving portion includes a truncated rear portion such that the nominal axial length of the receiving portion is about 1½ inches for an approximately 1½ inch diameter bore, and the truncated portion providing additional access space to the rear of the bit holder block.

28. The bit holder block of claim 26, wherein the bit holder receiving portion has a thickness defined by the length of the bit holder block bore that is less than a length of the base adjacent the bit holder receiving portion.

* * * * *